US005475906A

United States Patent [19]

Magdika

[11] Patent Number: 5,475,906

[45] Date of Patent: Dec. 19, 1995

[54] HEALD-SEPARATION APPARATUS FOR WARP-THREAD DRAWING-IN MACHINES

[75] Inventor: Janos Magdika, Trübbach, Switzerland

[73] Assignee: Stäubli AG, Horgen, Switzerland

[21] Appl. No.: 304,559

[22] Filed: Sep. 12, 1994

[30] Foreign Application Priority Data

Sep. 13, 1993 [CH] Switzerland ..... 02752/93

[51] Int. Cl.[6] ..... D03J 1/14

[52] U.S. Cl. ..... 28/205; 28/208

[58] Field of Search ..... 28/205, 206, 208; 271/24

[56] References Cited

U.S. PATENT DOCUMENTS

| | | | |
|---|---|---|---|
| 4,891,871 | 1/1990 | Tachibana et al. . | |
| 4,916,785 | 4/1990 | Tachibana et al. . | |
| 5,174,000 | 12/1992 | Wilhelm et al. | 28/205 |
| 5,184,380 | 2/1993 | Benz et al. . | |
| 5,274,894 | 1/1994 | Wilhelm et al. . | |
| 5,287,605 | 2/1994 | Badertscher . | |
| 5,309,615 | 5/1994 | Tachibana et al. | 28/205 X |

FOREIGN PATENT DOCUMENTS

| | | | |
|---|---|---|---|
| 0539062 | 4/1993 | European Pat. Off. | 28/205 |
| 0539061 | 4/1993 | European Pat. Off. | 28/205 |

OTHER PUBLICATIONS

"Automatic Drawing–in Equipment", Uster EMU, Zellweger Uster, Ltd., Switzerland, 8 pages, Jul., 1982. This document is mentioned at the top of p. 2 of the present application.

"Uster Delta", Zellweger Uster, 17 pages, Aug., 1989.

*Primary Examiner*—Andy Falik

*Attorney, Agent, or Firm*—Burns, Doane, Swecker & Mathis

[57] ABSTRACT

The separating apparatus contains carrier rails for the storage of healds in the form of a stack, a dividing-off member for pushing the foremost heald laterally out of the stack into an intermediate position, and a first transfer device for transporting the healds from the intermediate position in the direction of a heald carrier for transporting the healds to their drawing-in position. Provided in the region between the intermediate position and the heald carrier is a lock which contains a controlled clamp for clamping the carrier rails. The lock is briefly opened for transporting a separated heald past the lock to the heald carrier. The apparatus can be used to separate healds of all types, especially of those having closed end loops.

12 Claims, 6 Drawing Sheets

HEALD-SEPARATION APPARATUS FOR WARP-THREAD DRAWING-IN MACHINES

FIELD OF THE INVENTION

The present invention relates generally to a heald-separating apparatus for warp-thread drawing-in machines. More particularly, the present invention pertains to a heald-separating apparatus for warp-thread drawing-in machines with carrier rails for the storage of the healds in the form of a stack, with a dividing-off member for pushing the respective foremost heald laterally out of the stack into an intermediate position, and with a first transfer device for transporting the from the intermediate position in the direction of a heald carrier for transporting the healds to their drawing-in position.

BACKGROUND OF THE INVENTION

European Application No. 0 448 957, which corresponds to U.S. Pat. No. 5,184,380, describes an apparatus for the separation of healds having open end loops. In this apparatus, the carrier rails are fastened laterally to supporting arms, the connection between the carrier rails and supporting arms being made in the region of the open part of the end loops, so that the displacement of the healds on the carrier rails is not impeded by the supporting arms. Since the carrier rails have to be fixed as near as possible to the heald carrier in order to allow a fault-free transfer of the separated healds onto the heald carrier, it is clear that this known apparatus is not suitable for the separation of healds having closed end loops. This is because the supporting arms fixing the carrier rails cannot pass through the closed end loops surrounding the carrier rails on all sides.

An apparatus for separating healds having closed end loops is known from the drawing-in system in USTER EMU (USTER being a registered trademark of Zellweger Uster AG). In this apparatus, the carrier rails are clamped at one end only and reach with their flee end as far as a transfer station, at which the transfer onto the heald carder rails of the heald flames takes place. Special healds, which have an embossing allowing engagement of a separating knife, are used here. The separated healds are then pushed over the tree ends of the carrier rails into the transfer station by a transport member.

This apparatus uses carrier rails of very small length and is therefore unsuitable for automatic drawing-in machines. This is because an empty carrier rail has to be exchanged for a full one at very short intervals, and this always means an undesirable stopping of the drawing-in machine. Moreover, the carrier rails clamped only on one side constitute a considerable potential fault source, particularly at relatively high separating frequencies, such as are demanded nowadays from an automatic drawing-in machine.

OBJECT AND SUMMARY OF THE INVENTION

The present invention provides a heald-separating apparatus which allows a fault-flee separation of healds having closed end loops.

This is achieved, according to the invention, in that a lock having a first controlled clamp for the carrier rails is provided in the region between the intermediate position and the heald carrier, the lock being briefly opened for transporting a separated heald to the heald carrier.

A first preferred embodiment of the separating apparatus according to the invention involves providing the lock with a second controlled clamp arranged at a distance from the first clamp. The transport of the separated healds takes place in steps from the intermediate position up to the second clamp and from the second clamp up to the heald carrier, the second clamp being closed during the first transport step and the first clamp being closed during the second transport step.

A second preferred embodiment of the separating apparatus according to the invention involves the provision of a second transfer means. The first transfer means is provided for the first transport step from the intermediate position up to the second clamp, and the second transfer means is provided for the second transport step from the second clamp to the heald carrier.

BRIEF DESCRIPTION OF THE DRAWING FIGURES

The invention is explained in more detail below with reference to the accompanying drawing figures in which like elements bear like reference numerals and wherein.

DETAILED DESCRIPTION OF THE PREFERRED EMBODIMENTS.

Figure 1:
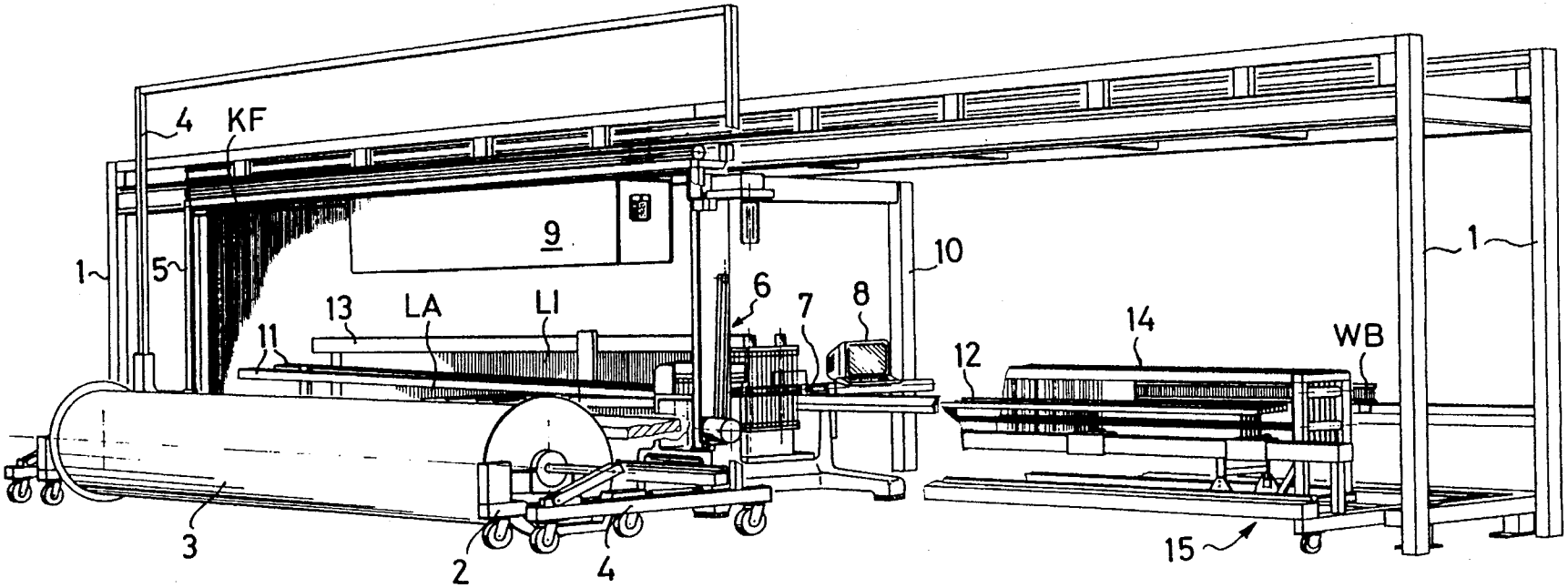
FIG. 1 is a general perspective view of a warp-thread drawing-in machine.

According to FIG. 1, the drawing-in machine consists of a basic stand 1 and of various subassemblies which are arranged in the stand and which each form an operating module. A warp-beam carriage 2 having a warp beam 3 arranged on it can be seen in front of the basic stand 1. Moreover, the warp-beam carriage 2 contains a lifting device 4 for holding a thread frame 5, on which the warp threads KF are tentered. This tentering takes place before the actual drawing-in and at a location separate from the drawing-in machine, the thread frame 5 being positioned, at the lower end of the lifting device 4, in the immediate vicinity of the warp beam 3. For the drawing-in, the warp-beam carriage 2 with the warp beam 3 and the lifting device 4 is moved up to the so-called setting-up side of the drawing-in machine and the thread frame 5 is lifted upwards by the lifting device 4 and suspended in the basic stand 1, where it then assumes the position shown.

The thread frame 5 is displaceable in the longitudinal direction of the basic stand 1 by a drive (not shown). During this displacement, the warp threads KF are guided past a thread-separating group 6 forming part of a so-called yam module and are at the same time separated and divided off. After being divided off, the warp threads KF are cut off and presented to a drawing-in needle 7 which forms an integral part of the so-called draw-in module. For dividing off the warp threads, for example, the dividing-off device used in the warp-tying machine USTER TOPMATIC can be employed.

Next to the drawing-in needle 7 can be seen a video-display unit 8 which belongs to an operating station and which serves for indicating machine functions and machine malfunctions and for data input. The operating station, which forms part of a so-called programming module, also contains an input stage for the manual input of particular functions, such as, for example, crawling speed, start/stop, repetition of operations, and the like. The control of the drawing-in machine is carried out by a control module which contains a control computer and which is arranged in a control box 9. This control box contains, in addition to the control computer, a module computer for each so-called main module, the individual module computers being controlled and monitored by the control computer. The main modules of the drawing-in machine are, in addition to the modules already mentioned, namely the draw-in module, yam module, control module and programming module, also the heald module, the drop-wire module and the reed module.

The thread-separating group 6, which presents to the drawing-in needle 7 the warp threads KF to be drawn in, and the path of movement of the drawing-in needle 7, which runs vertically relative to the plane of the tentered warp threads KF, determine a plane which is located in the region of a pillar 10 forming part of the basic stand. The pillar 10 separates the setting-up side already mentioned from the so-called stripping-off side of the drawing-in machine. On the setting-up side, the warp threads and the individual elements, into which the warp threads are to be drawn, are supplied, and on the stripping-off side the so-called harness (healds, drop wires and reed) together with the drawn-in warp threads can be extracted. During the drawing-in, the thread frame 5 together with the warp threads KF and the warp-beam carriage 2 together with the warp beam 3 are moved to the right past the thread-separating group 6, the drawing-in needle 7 extracting from the frame 5 in succession the warp threads KF which are tentered on the latter.

When all the warp threads KF are drawn in and the thread frame 5 is empty, the latter, together with the warp-beam carriage 2, the warp beam 3 and the lifting device 4, is located on the stripping-off side and can be removed from the basic stand 1.

Directly behind the plane of the warp threads KF are arranged the warp-thread stop-motion drop wires LA, behind these the healds LI, and further to the rear the reed. The drop wires LA are stacked in hand magazines, and the full hand magazines are suspended in feed rails 11 which are arranged at an inclination and on which they are transported to the right towards the drawing-in needle 7. There, they are separated and brought into the drawing-in position. After drawing-in has taken place, the drop wires LA pass on to drop-wire carrier rails 12 on the stripping-off side.

The healds LI are lined up on rails 13 and are displaced on these manually or automatically to a separating stage. The healds LI are then brought individually into their drawing-in position and, after drawing-in has taken place, are distributed to the corresponding carrier rails 14 on the stripping-off side. The reed is likewise moved in steps past the drawing-in needle 7, the corresponding reed gap being opened for the drawing-in. After the drawing-in, the reed is likewise located on the stripping-off side. Part of the reed WB can be seen on the right next to the carrier rails 14. This representation is to be understood purely as an illustration, because, in the represented position of the frame 5, the reed is, of course, located on the setting-up side.

As can also be seen from FIG. 1, a so-called harness carriage 15 is provided on the stripping-off side. This, together with the drop-wire carrier rails 12 fastened on it, the carrier rails 14 and a mounting for the reed, is pushed into the basic stand 1 into the position shown and, after the drawing-in, carries the harness together with the drawn-in warp threads KF. At this moment, the warp-beam carriage 2 together with the warp beam 3 is located directly in front of the harness carriage 15. The harness is then transferred by means of the lifting device 4 from the harness carriage 15 on to the warp-beam carriage 2 which then carries the: warp beam 3 and the drawn-in harness and which can be moved up to the respective weaving machine or into an intermediate store.

The functions described are distributed to a plurality of modules which constitute virtually independent machines controlled by the common control computer. The cross-connections between the individual modules run by way of this overriding control computer and there are no direct cross-connections between the individual modules. The already mentioned main modules of the drawing-in machine are themselves again constructed in a modular manner, and, as a rule, consist of part modules.

Figure 2:
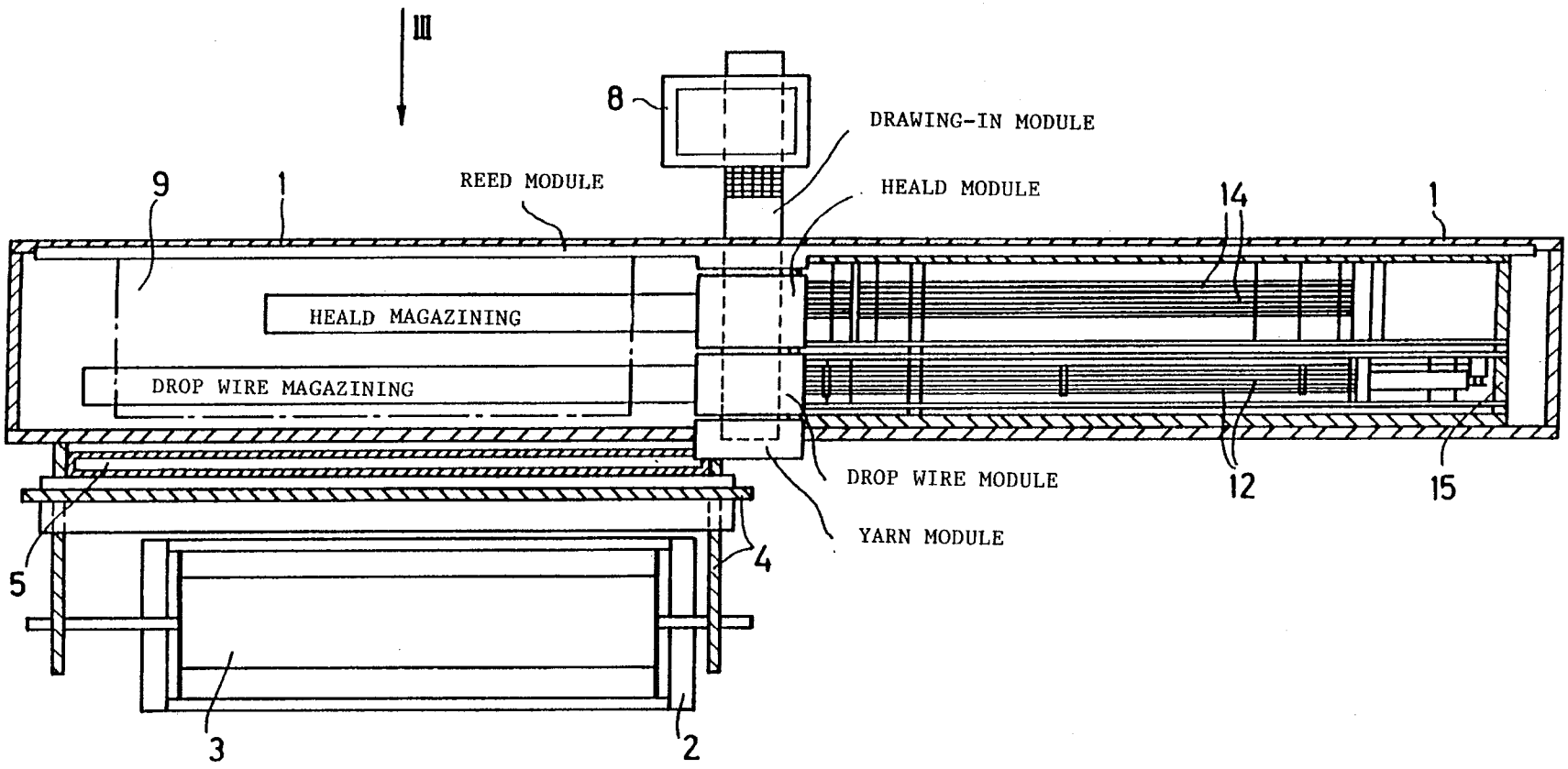
FIG. 2 is a diagrammatic top view of the drawing-in machine of FIG. 1.

This modular construction, described in CH-A579,871, can be seen particularly clearly from the representation of FIG. 2. FIG. 2 shows the basic stand 1, the warp-beam carriage 2 with the warp beam 3, the lifting device 4 and the thread frame 5 which are coupled together with the warp-beam carriage 2, the yarn module, the drop-wire module, the heald module, the reed module, the operating station with the video-display unit 8, the draw-in module, the control box 9, the heald magazining part module, the drop-wire magazining part module and the harness carriage 15 with the drop-wire carrier rails 12 and the carrier rails 14.

As can be understood from the already mentioned CH-A579,871, the heald module, which works off the healds LI from the magazine stack up to the heald carrying a drawn-in warp thread, on a carrier rail 14, consists of the following part modules:

Heald magazine: acceptance of the healds by the user from the stack, transfer of the heald stacks to the "heald separation" part module.

Heald separation: reception of the heald stacks, separation of the healds from the stack, transfer of the separated healds to the "heald positioning" part module.

Heald positioning: take-over of the healds from the "heald separation" pan module, transport of the healds to the drawing-in position, lateral and vertical positioning of the healds, transport of the healds together with the drawn-in warp thread to the predetermined carrier-rail position, transfer of the healds onto the respective carrier rail.

Heald conveyance: conveyance of the healds together with the drawn-in warp threads along the carrier rails from the filling-up side to the other end.

The "heald separation" part module for working off healds having open end loops is described in U.S. Pat. No. 5,184,380, and the "heald positioning" part module is described in European Application No. 0,500,848 (=WO-A-92/05303). First the "heald magazine" part module and thereafter the "heald separation" part module will now be described below, specifically, in each case, for working off healds having closed end loops.

Figure 3:
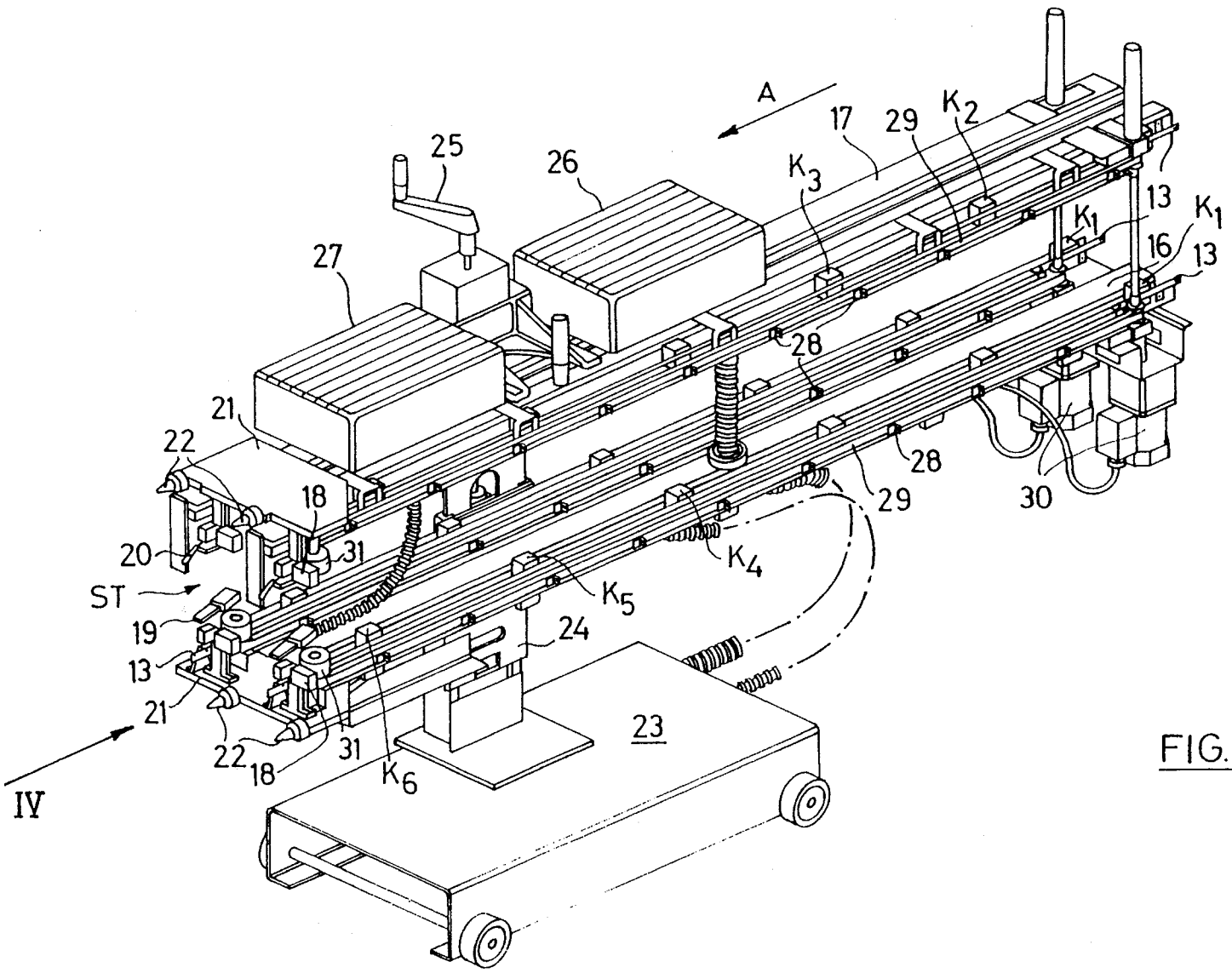
FIG. 3 is a top perspective view of the heald module of the drawing-in machine of FIG. 2, as seen in the direction of the arrow III of FIG. 2.

As can be seen from FIG. 3, the heald magazine consists essentially of lower and upper profiled rails 16 and 17, in which the heald carrier rails 13 and means for conveying the healds lined up on the carrier rails to the separating station are mounted. The separating station, designated by ST in FIG. 3, directly follows the heald carrier rails 13. The separating station ST possesses, for each heald carrier rail 13, an upper and a lower separating stage respectively, with a separating knife 18 movable transversely relative to the heald stack, and one or two transferrers 19. Moreover, a common separating finger 20 is provided for the two separating stages. All these members are described in detail in U.S. Pat. No. 5,184,380, the disclosure of which is incorporated herein by reference.

As illustrated, the heald magazine is of a two-path design and contains two pairs of heald carrier rails 13 and separating stages. A solid plate 21 is fastened to the end face of each of the profiled rails 16 and 17 located on the same side as the separating stage and carries two pins 22 projecting on the end face. These pins serve as an interface with the "heald positioning" part module and are provided for engagement and fixing in corresponding recesses of this part module.

The two profiled rails 16 and 17 are fastened vertically adjustably on a carrier 24 mounted on a rail-guided sliding carriage 23. The distance between the end loops of the healds can be adjusted for by means of a crank 25. The offset of the thread eyes is likewise adjustable. The reference symbol 26 denotes a housing with the electrics and electronics, and the reference symbol 27 denotes a housing for the pneumatic control. The two housings 26, 27 are connected via corresponding lines to the sliding carriage 23 which is itself connected to corresponding supply and data lines of the drawing-in machine and thereby especially also to the control module in the control box 9 (FIGS. 1 and 2).

Held on each profiled rail 16, 17 are two heald carrier rails 13 which extend from the end of the profiled rails on the right in FIG. 3, that is to say the feed side of the heald magazine, as far as the separating station ST and which have a length of more than two meters. The healds to be magazined are lined up on so-called transfer rails (not shown); that is, a pair of rails which are connected to one another at one end by means of a web and which project freely forwards from this web. The web serves not only as a carrier of the transfer rails, but is also a kind of grip for handling them. To fill the heald magazine, the transfer rails together with the healds located on them are docked by means of clamps up against the feed ends of the heald carrier rails 13 and are pushed onto the heald carrier rails.

After a relatively short displacement by hand, the healds come into the effective range of a transport means which conveys the healds in the direction of the arrow A towards the separating station ST. This transport means is formed by a conveyor belt 29 equipped with laterally projecting brushes 28 which contact the healds. A conveyor belt 29 of this type is arranged along each heald carrier rail 13. Each pair of conveyor belts 29 assigned to a path of the heald magazine is driven by its own motor 30. Shortly in front of the separating station ST there is arranged laterally next to each heald carrier rail 13 a motor-driven pressure brush 31 which conveys the healds towards the respective separating stage and which ensures a constant built-up pressure in the separating station ST.

The heald magazine illustrated in FIG. 3 is of universal use and is suitable for the magazining of healds having open end loops and of those having closed end loops. Healds having open end loops can be stored without difficulty because they have hook-like end loops and can therefore be displaced easily on the carrier rails when only the carriers holding the carrier rails are located in the region of the open part of the end loops, that is to say the jaw of the hook. In contrast, healds having closed end loops can be displaced only on carrier rails free all-round, but this cannot be put into practice with carrier rails having a length of more than half a meter. In the heald magazine illustrated, the displaceability of healds having closed end loops on the heald carrier rails 13 becomes possible in that each heald carrier rail 13 is held by a plurality of controlled clamps $K_1$ to $K_6$ consequently the transport path of the healds on the carrier rails is subdivided into a plurality of sections, each receiving one heald set. The transport of the healds takes place in sets from section to section, and during the displacement from one section to the next the respective clamp located between these sections is opened.

The opening and closing of the clamps $K_1$ to $K_1$ are controlled in such a way that two clamps located next to one another can never be opened simultaneously. To control the clamps, detectors for the passage of healds are arranged in direct proximity to the clamps. When the heald magazine is empty and the first heald stack is pushed from the transfer rails onto the heald carrier rails 13, the detector arranged at the first clamp $K_1$ detects the presence of this heald stack at the first clamp and opens the latter. The heald stack can thus pass through the first clamp, come into the effective range of the conveyor belt 29 equipped with the brushes 28 and be pushed automatically by this to the second clamp $K_2$.

After a specific adjustable time span of, for example, nine seconds, the first clamp $K_1$ closed, and the automatic transport of the heald stack to the separating station ST commences, this taking place in steps from clamp to clamp. As soon as the clamp $K_2$ is closed again and the detector at the clamp $K_2$ detects the presence of healds, the clam $K_2$ is opened, specifically until its detector no longer detects any healds. The clamp $K_3$ is then opened, and so on and so forth. As soon as the section between the clamps $K_1$ and $K_2$ is empty and the clamp $K_2$ is closed again, a new heald stack can be transferred from the transfer rails. During the transport of a heald stack through the not completely empty, but at least partially filled heald magazine, the opening of a clamp depends on a further criterion, specifically on whether the section following the clamp to be opened is empty. Whether this criterion is fulfilled is detected by means of the signal from the detector at the clamp terminating the section in the direction of transport A. If this detector records the complete passage of the previous heald stack, the respective section is empty. The signals from the individual detectors are processed in a common control in the housing 26, and, as a result of the transport of the heald stacks in sets from section to section, the control always "knows" in which section a specific heald stack is just located, and which sections are empty and which are full. Build-ups in the sections or an overfilling of the sections are thereby prevented.

Further details of the "heald magazine" part module, especially the clamps $K_1$ to $K_6$ and the detectors, are described in a U.S. patent application Ser. No. 08/304,199 filed on the same date as the present application and entitled "Apparatus for the Handling of Healds for Warp-Thread Drawing-In Machines".

The separation station ST will now be described below, and, as already mentioned, reference is made to the disclosure of U.S. Pat. No. 5,184,380 describing a separating station for drop wires having open end loops. It can be said, in somewhat simplified form, that the heald separation as such and the means for carrying out the separation are the same for healds having closed end loops as for those having open end loops. The difference arises in the transfer of the separated healds onto the heald carrier provided for transporting the healds to their drawing-in position.

The heald carrier, described in WO-A 92/05303, comprises, inter alia, two vertically spaced transport planes, in each of which an endless transport means is guided in the manner of a belt or chain. The transport means are provided with pin-like heald holders, in which the healds are suspended by means of their end loops. The means for transferring the separated healds onto the heald carrier therefore perform the function of displacing the separated healds on their carrier rails in the direction of the heald carrier and transferring them to the heald holders. For this purpose, the carrier rails have, at their end facing the heald holders, a U-shaped or semicircular recess which is located level with the path of movement of the heald holders and which surrounds the free end of the latter. The ends of the carrier rails and the heald holders thereby overlap one another, thus guaranteeing a reliable heald transfer onto the heald holders.

Figure 4:
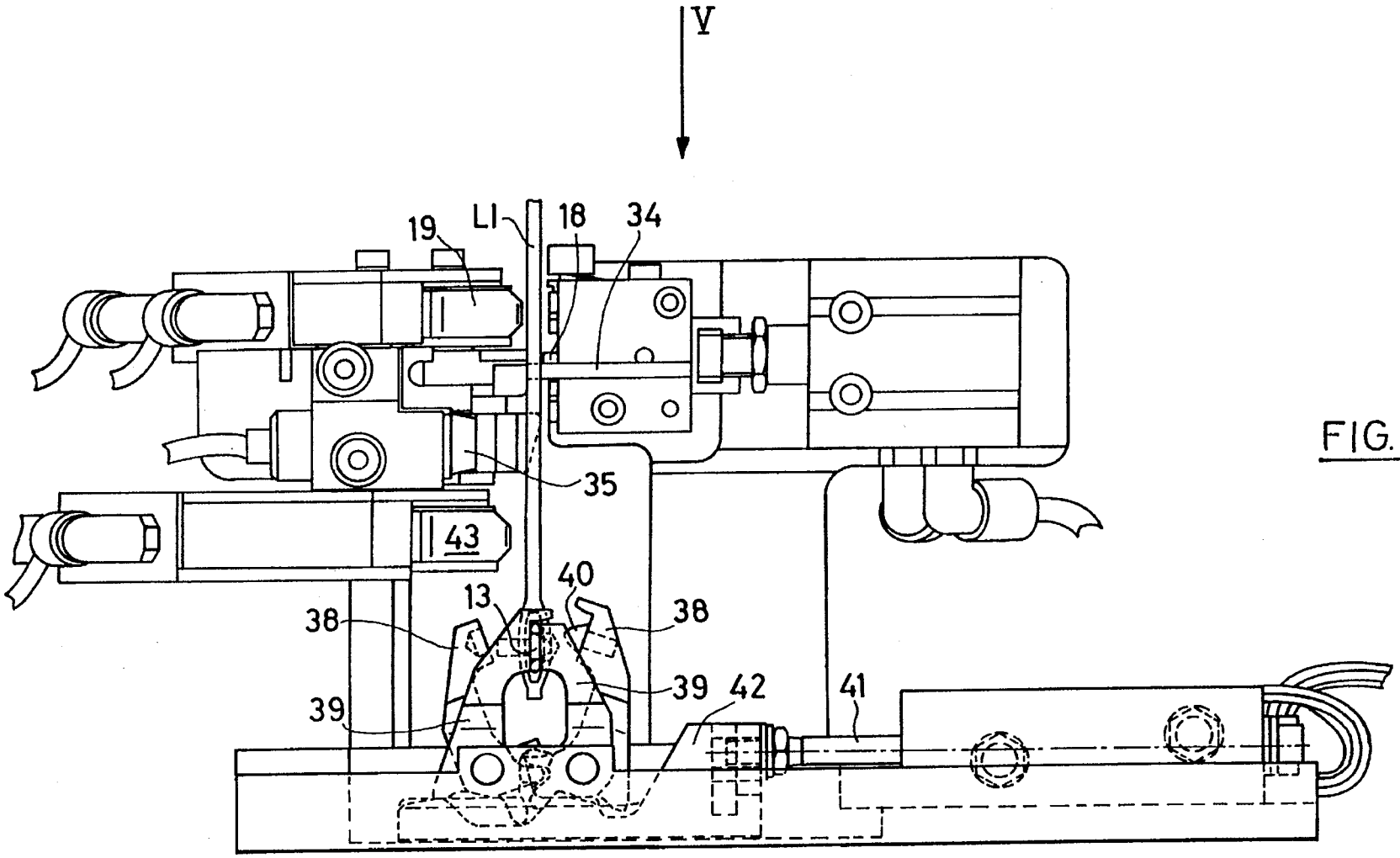
FIG. 4 is an end view of a detail of the heald module in the direction of the arrow IV of FIG. 3.
Figure 5:
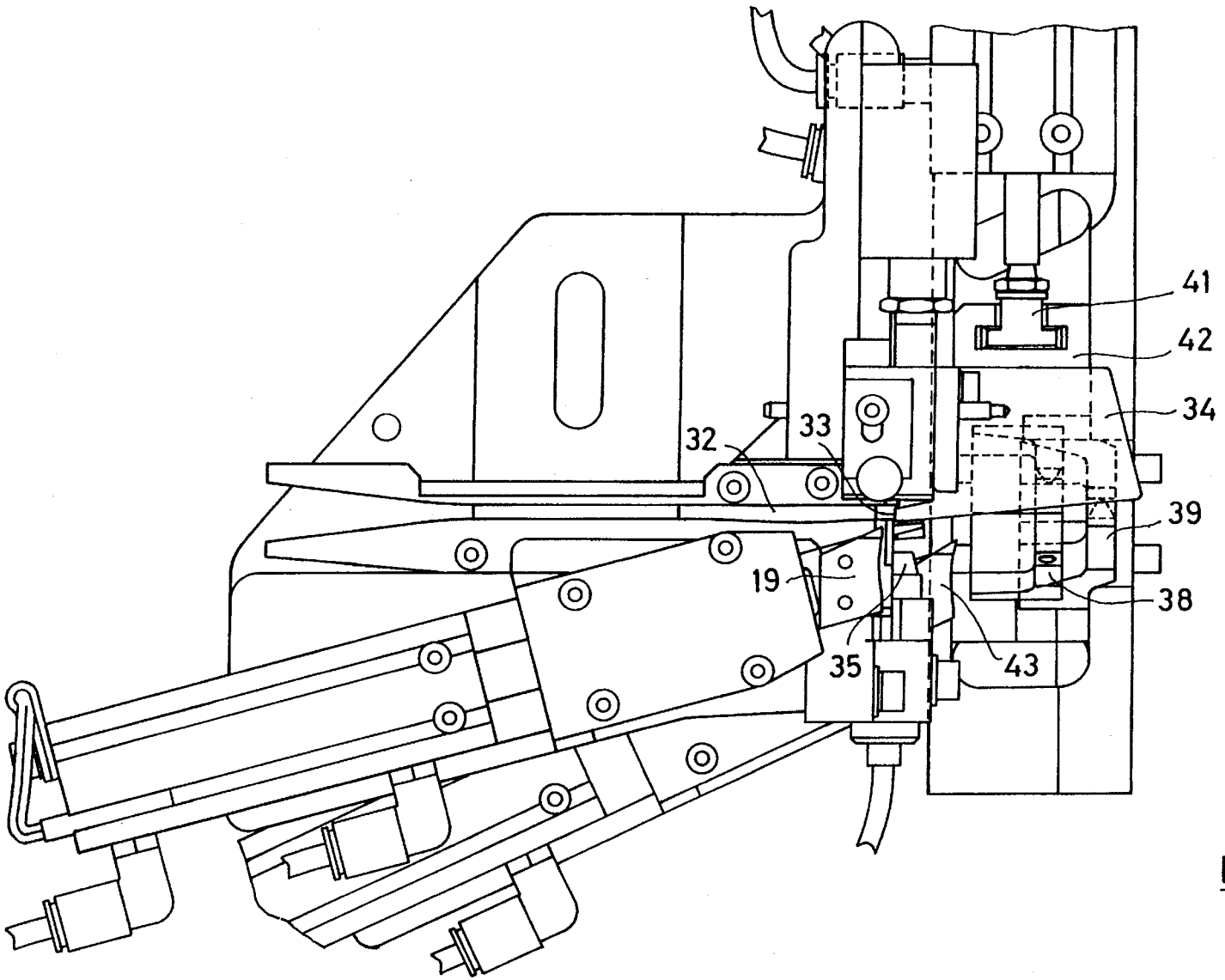
FIG. 5 is a view of the heald module in the direction of the arrow V of FIG. 4; and FIGS. *6a–6d* are diagrammatic representations of the operating cycle of a portion of the heald module during heald separation and heald transfer.

FIG. 4 shows a view of the lower separating stage of the separating station ST in the direction of the arrow IV of FIG. 3, that is to say as seen from the heald carrier, and FIG. 5 shows a top view of the lower separating stage in the direction of the arrow V of FIG. 4. As described in U.S. Pat. No. 5,184,380 mentioned above, there is formed in the separating stage a guide channel 32 for a stack of healds which is pressed forwards by the conveyor belts 29 and the pressure brush 31 (FIG. 3) towards the end of the guide channel 32 on the right in FIG. 5 and located on the separating side. Arranged at this end, in front of the guide channel 32, is a stop 33 which is worked onto a guide plate 34.

The foremost heald LI is located outside the guide channel 32 and is pushed laterally out of the heald stack into an intermediate position by the pneumatically driven separating knife 18. At the same time, a fingerlike transmitter 36 (FIG. 6*a*) assigned to a sensor 35 is moved up against the sensor 35 by the heald LI, with the result that a sensor signal actuating the separation is generated. This sensor signal triggers a working stroke of the first transferrer 19 which displaces the heald along a guide edge of the guide plate 34 away from the heald stack towards the heald holder designated in FIGS. 6*a*–6*d* by the reference numeral 37. The first transferrer can be include a tappet that is adjustable or movable toward the heald carrier 37.

When healds having closed end loops are worked off, in the region of the separating station the carrier rails 13 project freely forwards away from the clamp $K_6$ (FIG. 3) towards the heald holders, specifically over a length of approximately 25 cm. It has been shown that, during operation, the free ends of the carrier rails 13 tend to vibrate, and this can have a disturbing influence both on the separation of the healds and on their transfer onto the heald holders. To prevent such disturbances and to allow a reliable separation and transfer, there is provided at the free ends of the carrier rails 13, in the region of the separating station, a controlled lock which, in the normal state, is closed and fixes the carrier rail and which is briefly opened for a respective heald passage.

As illustrated, in FIG. 4 the controlled lock is formed by a pair of clamps 38 and 39 which each consist of two clamping jaws. One of the two clamping jaws carries a respective projecting cone 40 which is provided for penetration into a corresponding bore of the carder rail 13. The two cones 40 of the pair of clamps are arranged on different sides of the carrier rail 13 so that the cone 40 of the one clamp moves into the carrier rail from one side and the cone 40 of the other clamp from the other side of the carrier rail.

The drive of the clamp 38, 39 takes place by means of a slotted link 42 which is driven by a pneumatic tappet 41 and which acts on correspondingly designed ends of the clamping jaws and drives these positively. The adjustment of the clamps 38, 39 is consequently fully under control at all times.

The clamps 38, 39 are at a distance from one another of a few millimeters. The heald transfer proceeds in that the separated heald LI is first transported in a first step by the first transferrer 19 through the opened first clamp 38 up to the closed second clamp 39 (the position of the heald LI after this first step is shown in FIG. 4) and subsequently, with the first clamp 38 closed, through the open second clamp 39 to the heald holder 37 and is suspended in the latter. The second transport-step from the second clamp 39 to the heald holder 37 takes place by means of a second transferrer 43. The second transferrer can be in the form of a tappet that is adjustable or movable toward the heald carrier 37. In FIGS. 6*a*–6*d*, the operating cycle during the heald separation and heald transfer is represented diagrammatically. The arrows indicated in the individual figures each symbolize a movement, and its direction, which has taken place immediately before the instantaneous state shown in the respective figure.

Figure 6A:
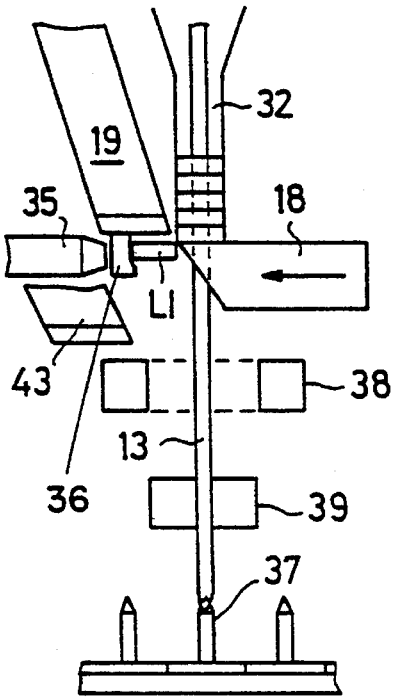

FIG. 6*a* shows the instantaneous state immediately after the separation. The foremost heald LI has been pushed or bent laterally out of the heald stack by the separating knife 18, the heald end loops continuing to be guided on the carrier rails 13. During its lateral displacement, the heald LI has moved the transmitter 36 up against the sensor 35 which generates a separating signal immediately after separation has taken place. At this moment, the first clamp 38 of the lock has just been opened and the second clamp 39 is closed.

Figure 6B:
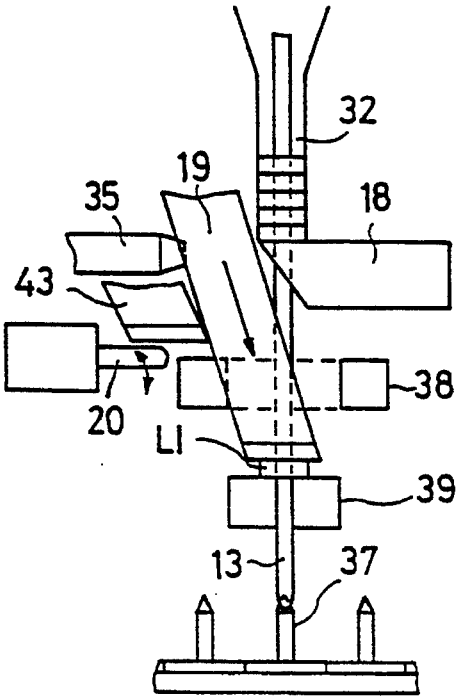

FIG. 6*b* shows the first step of the heald transfer; this state is also shown in FIG. 4. The separating signal of the sensor 35, triggered by the completely separated heald, has triggered a working stroke of the first transferrer 19, with the result that the separated heald LI is transported from the intermediate position shown in FIG. 6*a* through the open first clamp 38 to the closed second clamp 39. At the end of this transport movement, the separating finger 20 is activated and, as a result of a pivoting movement transverse to the carrier rail 13, separates the separated heald LI, possibly linked to the next heald in the region of the thread eye, from the heald stack completely.

Figure 6C:
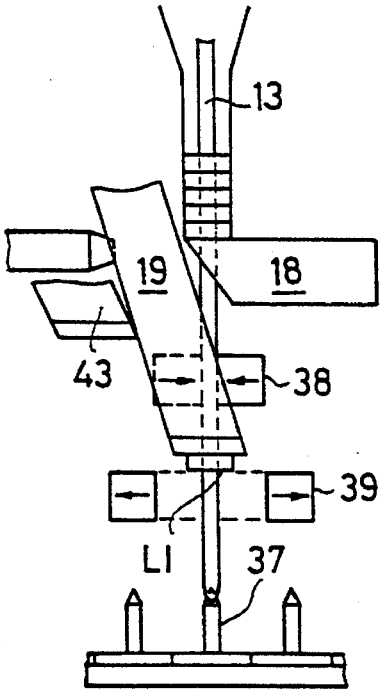

As soon as the first transferrer 19 is moved out completely and the separated heald LI has reached the second clamp 39, the operating step which is shown in FIG. 6*c* and which relates to the lock formed by the two clamps 38 and 39 takes place. Specifically, the lock is now prepared for the transfer of the heald LI onto the heald holder 37. For this purpose, first the first clamp 38 is closed and subsequently the second clamp 39 is opened, with the result that the state shown in FIG. 6*c* is assumed.

Figure 6D:
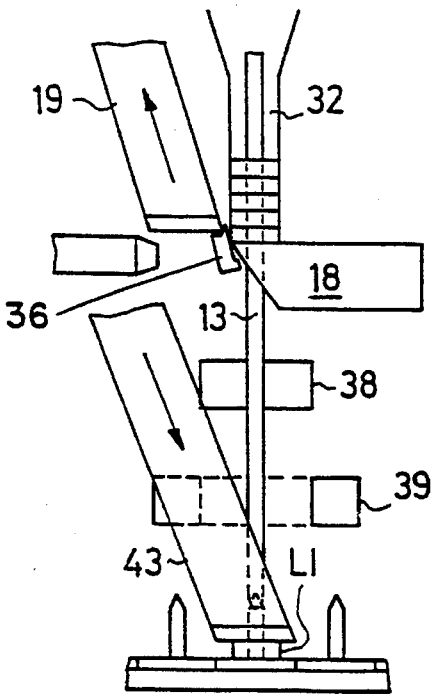

FIG. 6*d* shows the second and last step of the heald transfer from the second clamp 39 onto the heald holder 37. After the opening of the second clamp 39, the second transferrer 43 is moved out of its position of rest shown in FIGS. 6*a*–6*c*and encounters the heald LI positioned in front of the now open second clamp 39. The heald is displaced further on the carrier rail 13 by the second transferrer 43 and is finally suspended on the needle-shaped heald holder 37. During this time, the first transferrer 19 has moved back into its position of rest, with the result that the state shown in FIG. 6*d*is assumed.

After a corresponding sensor has detected the take-over of the heald by the heald holder 37 (see in this respect WO-A-92/05303, particularly FIG. 3), the second transferrer 43 is also moved back into its position of rest and the second clamp 39 is closed. The first clamp 38 is then opened and the separating knife 18 is moved back into its initial position laterally next to the guide channel 32. The foremost heald of the heald stack can consequently come out of the guide channel 32 and be separated by means of a corresponding transverse movement of the separating knife 18, with the result that the instantaneous state shown in FIG. 6*a* is then assumed once again.

FIGS. 4 and 5 show the lower stage of the separating station ST (FIG. 3) mounted on the lower profiled rail 16; the upper stage is mounted mirror-symmetrically thereto on the upper profiled rail 17, the separating finger 20 forming an integral part of the upper stage. The separating finger 20 depicted in FIG. 3 can be designed as a so-called twin or tandem finger and have a form in the shape of a tuning fork. This tandem finger is used for the separation of healds having open end loops. The separating station illustrated and described for healds having closed end loops is, of course, also suitable for the separation of healds having open end loops, but it is more complicated and more expensive than the separating station for healds having open end loops which is described in U.S. Pat. No. 5,184,380.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. Heald-separating apparatus for warp-thread drawing-in machines, comprising a carrier rail for the storage of a stack of healds, a dividing-off member for pushing a foremost heald in the stack laterally out of the stack into an intermediate position, first transfer means for transporting the healds from the intermediate position in the direction of a heald carrier which is adapted to transport the healds to a drawing-in position, a lock having a first clamp for clamping the carrier rail in a region between the intermediate position and the heald carrier, and an operating device operatively associated with said lock to briefly open the lock and permit a separated heald to be transported past the lock to the heald carrier.

2. Heald-separating apparatus according to claim 1, wherein the lock has a second controlled clamp arranged at a distance from the first clamp, the separated healds being transported in steps that include a first transport step from the intermediate position up to the second clamp and a second transport step from the second clamp up to the heald carrier, the first clamp being closed by the operating device during the second transport step and the second clamp being closed by an operating device during the first transport step.

3. Heald-separating apparatus according to claim 2, including second transfer means for transporting the separated healds over the second transport step from the second clamp to the heald carrier, the first transfer means transporting separated healds over the first transport step from the intermediate position up to the second clamp.

4. Heald-separating apparatus according to claim 3, wherein each of the two controlled clamps has a clamping gripper comprised of two clamping jaws.

5. Heald-separating apparatus according to claim 4, wherein the clamping jaws are driven positively by a common device.

6. Heald-separating apparatus according to claim 5, wherein the common operating device has a pneumatically actuable slotted link acting on the clamping jaws.

7. Heald-separating apparatus according to claim 6, wherein the clamping jaws are comprised of two-armed levers and are mounted on pivot axes, one end of each clamping jaw being engageable with the carrier rail and an opposite end being engageable with the slotted link of the drive.

8. Heald-separating apparatus according to claim 7, wherein said one end of one of the clamping jaws of each clamp includes a fixing member for engaging a bore provided in the carrier rail.

9. Heald-separating apparatus according claim 3, wherein the first transfer means includes a tappet having a stroke adjustable in a direction toward heald carrier, the second transfer means including a tappet having a stroke adjustable in a direction toward the heald carrier.

10. Heald-separating apparatus according to claim 9, wherein the two tappets are connected to separate drives that drive the tappets such that tha tappet for the first transport step is not moved back into its initial position before the commencement of the second transport step.

11. Heald-separating apparatus according to claim 9, wherein the tappet of the first transfer means is arranged above the tappet of the second transfer means.

12. Heald-separating apparatus according to claim 9, wherein the tappet of the first transfer means is arranged below the tappet of the second transfer means.

* * * * *